US005697388A

United States Patent [19]

Chang

[11] Patent Number: 5,697,388

[45] Date of Patent: Dec. 16, 1997

[54] HAIR CLIP IMPROVEMENT

[76] Inventor: Wen-Hsiung Chang, No. 32, Lane. 232, Chung Shan Road, Tainan, Taiwan

[21] Appl. No.: 563,304

[22] Filed: Nov. 28, 1995

[51] Int. Cl.[6] ..... A45D 8/20

[52] U.S. Cl. ..... 132/277; 132/278; 132/279

[58] Field of Search ..... 132/273, 276, 132/277, 279, 280, 281, 282, 283, 284; D28/38, 39, 40, 41

[56] References Cited

U.S. PATENT DOCUMENTS

| | | | |
|---|---|---|---|
| 1,194,844 | 8/1916 | Kalinowska | 132/277 |
| 2,166,460 | 7/1939 | Burns | 132/277 |
| 3,362,052 | 1/1968 | Uchida | 132/277 |
| 5,494,060 | 2/1996 | Potut | 132/277 |
| 5,522,407 | 6/1996 | Kelsey | 132/277 |

*Primary Examiner*—Gene Mancene
*Assistant Examiner*—Pedro Philogene
*Attorney, Agent, or Firm*—Morton J. Rosenberg; David I. Klein

[57] ABSTRACT

A hair clip is provided which comprises a pair of clipping elements combined together by pins received within pin holes respectively formed in connecting protrusions. Furthermore, snap holders are provided on the outward side of the clipping elements to retain two snap ends of two elastic rings having great resilience, to enable the clipping elements to clip hair tightly.

1 Claim, 5 Drawing Sheets

HAIR CLIP IMPROVEMENT

BACKGROUND OF THE INVENTION

A heretofore known hair clip, as shown in FIG. 8 was provided which comprises:

a pair of clipping elements 2 each of which has two connecting protrusions 22 each having a pin hole 221; a metal pin 23; and a torsion spring 24.

The clipping elemement 2 further has a finger press 21 and a plurality of clipping teeth 25; the finger press 21 being provided for a user to exert force thereon with his finger in order to open the hair clip, the clipping teeth 25 being provided for things to be clipped in between.

Both clipping elements 2 are combined together by means of the connecting protrusions 22 and the metal pin 23 which is inserted through all the pain holes 221 and the torsion spring 24 is inserted with the pin 23 and positioned between two pairs of adjacent connecting protrusions 22.

When users press two finger presses 21 inwardly, two clipping teeth 25 will seperate for things or hair to be placed in between; then when the users release the finger presses 21, the things or hair will be clipped firmly by means of the resilience of the torsion spring 24.

However the hair clip as described above has disadvantages as follows:

1. the torsion spring 24 may rust due to water or moisture and so may be broken when user exert force on the hair clip;
2. if the connecting protrusions 22 break when users are using the clip, the torsion spring 24 is likely to bounce out and injure people.

SUMMARY OF THE INVENTION

An improvement on a hair clip is provided comprising elastic rings and two clipping elements which have finger presses for users to exert force thereon and clipping teeth to clip hair.

One of the clipping element is provided with connecting protrusions having pins protruding therefrom to connect with pin holes of the other clipping element.

The clipping elements further have snap holders to retain snap ends of the elastic rings to provide the hair clip with clipping function by means of resilience of the elastic rings.

BRIEF DESCRIPTION OF THE DRAWINGS

The invention will be better understood by reference to the following drawings, wherein.

DESCRIPTIOIN OF THE PREFERRED EMBODIMENTS

Figure 1:
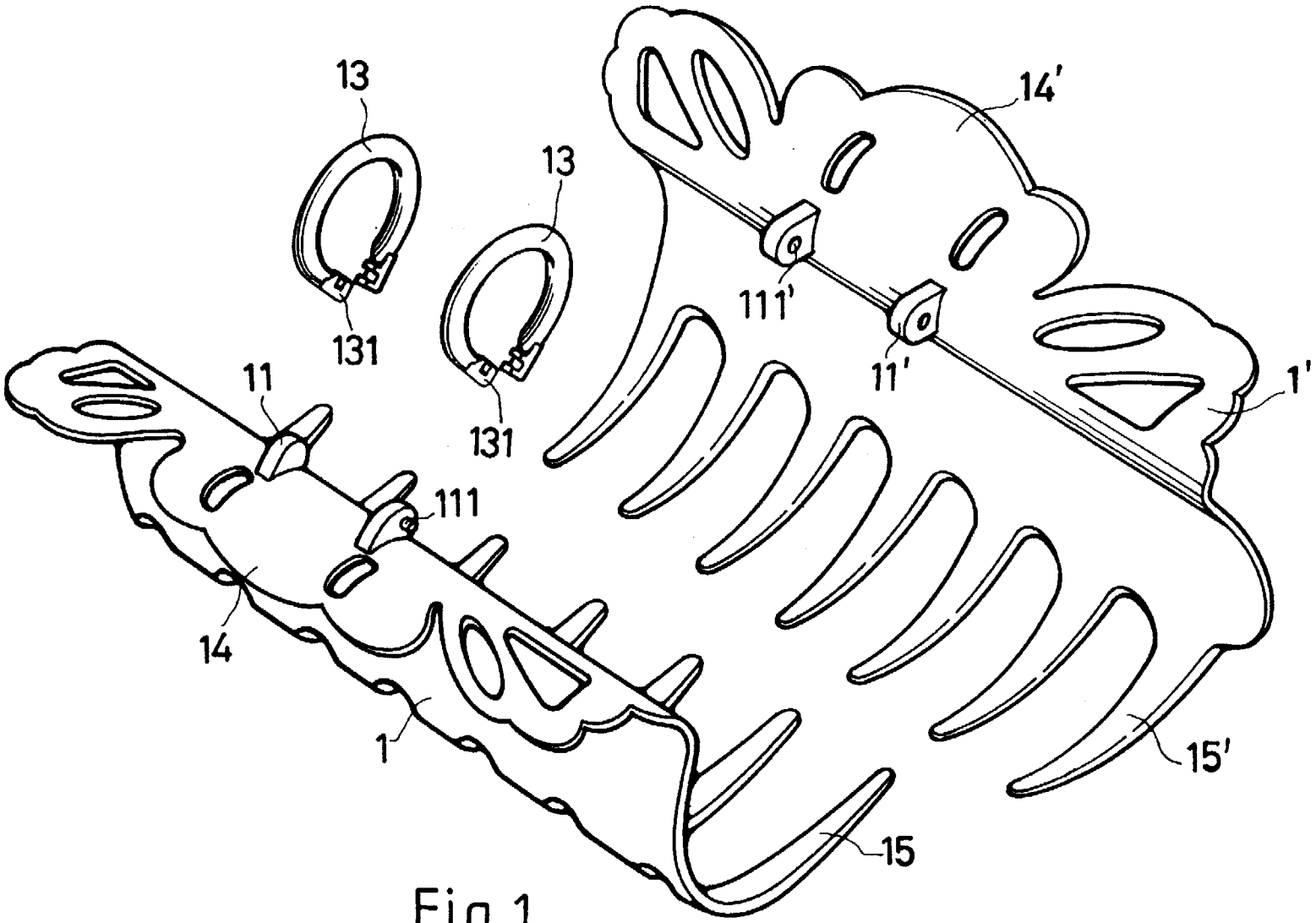
FIG. 1 is a view showing the appearance of the hair clip of the present invention.

A hair clip of the present invention as shown in FIG. 1 is provided comprising:

a clipping element 1 having a finger press 14, a plurality of clipping teeth 15 and two connecting protrusions 11 which erect on the inner side and each of which has a pin 111;

a clipping element 1' having a finger press 14, a plurality of clipping teeth 15' and two connecting protrusions 11' each of which has a pin hole 111' for the pins 111 to be inserted therethrough and housed therein; and, two elastic rings 13 which are made of plastic steel and have great resilience and each of which further has a snap end 131.

Figure 2:
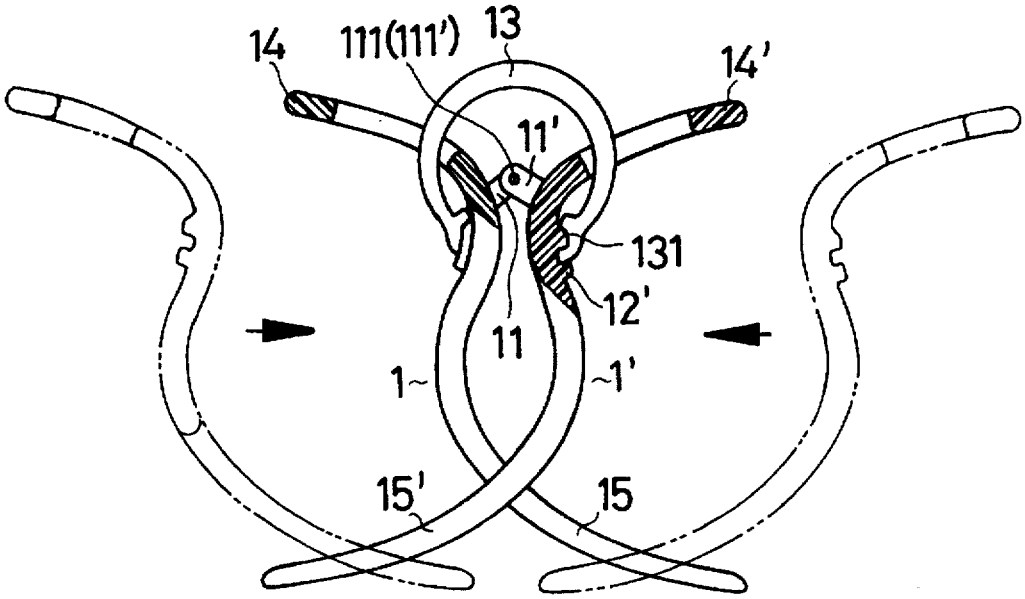
FIG. 2 is a view showing the appearance of the hair clip of the present invention in combination.
Figure 7:
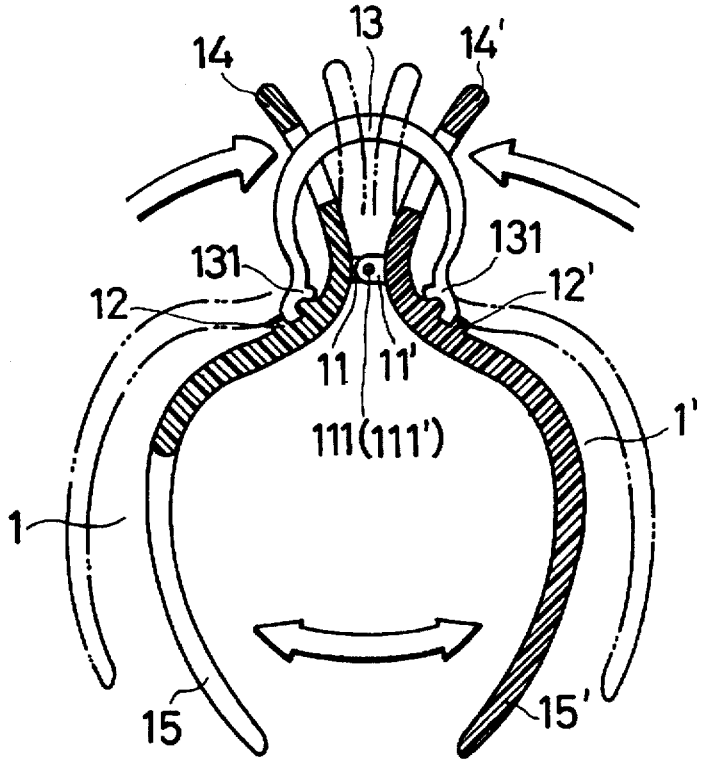
FIG. 7 is view illustrating the use of the hair clip of the present invention; and, FIG. 8 is a view showing the appearance of a heretofore know hair clip as described in the background.
Figure 3:
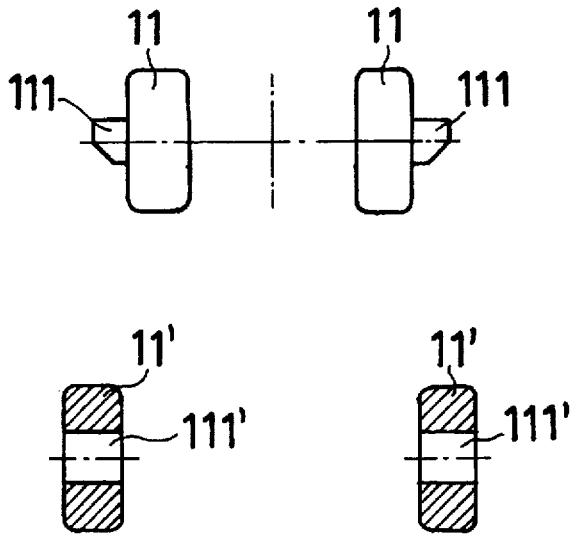
FIG. 3 is a cross-sectional view of the parts, connecting protrusions 11, 11' of the hair clip of the present invention.
Figure 4:
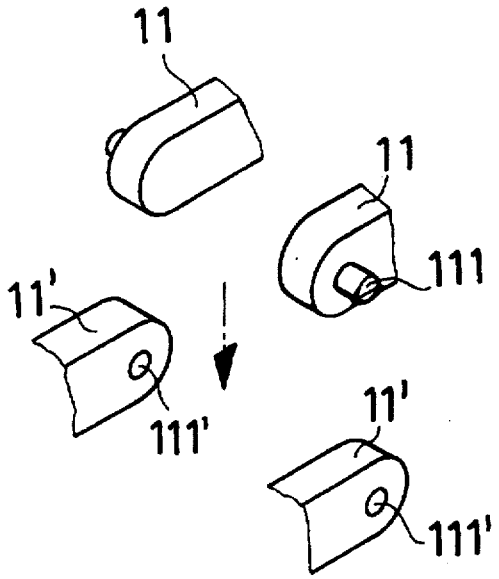
FIG. 4 is a view illustrating the way of combining the parts shown in FIG. 3.
Figure 5:
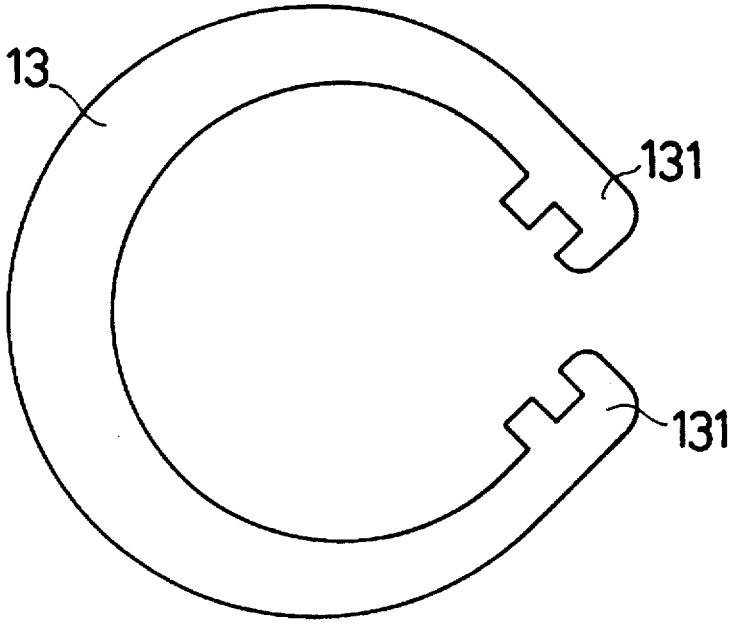
FIG. 5 is a top view of an elastic ring of the present invention.
Figure 6:
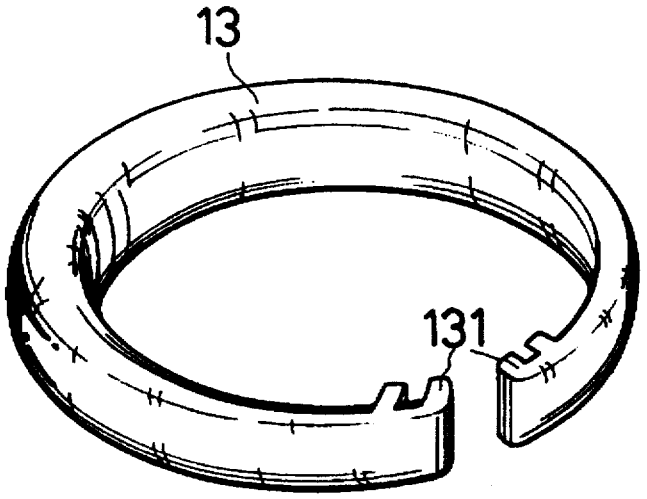
FIG. 6 is a view showing the appearance of the elastic ring of the present invention.
Figure 8:
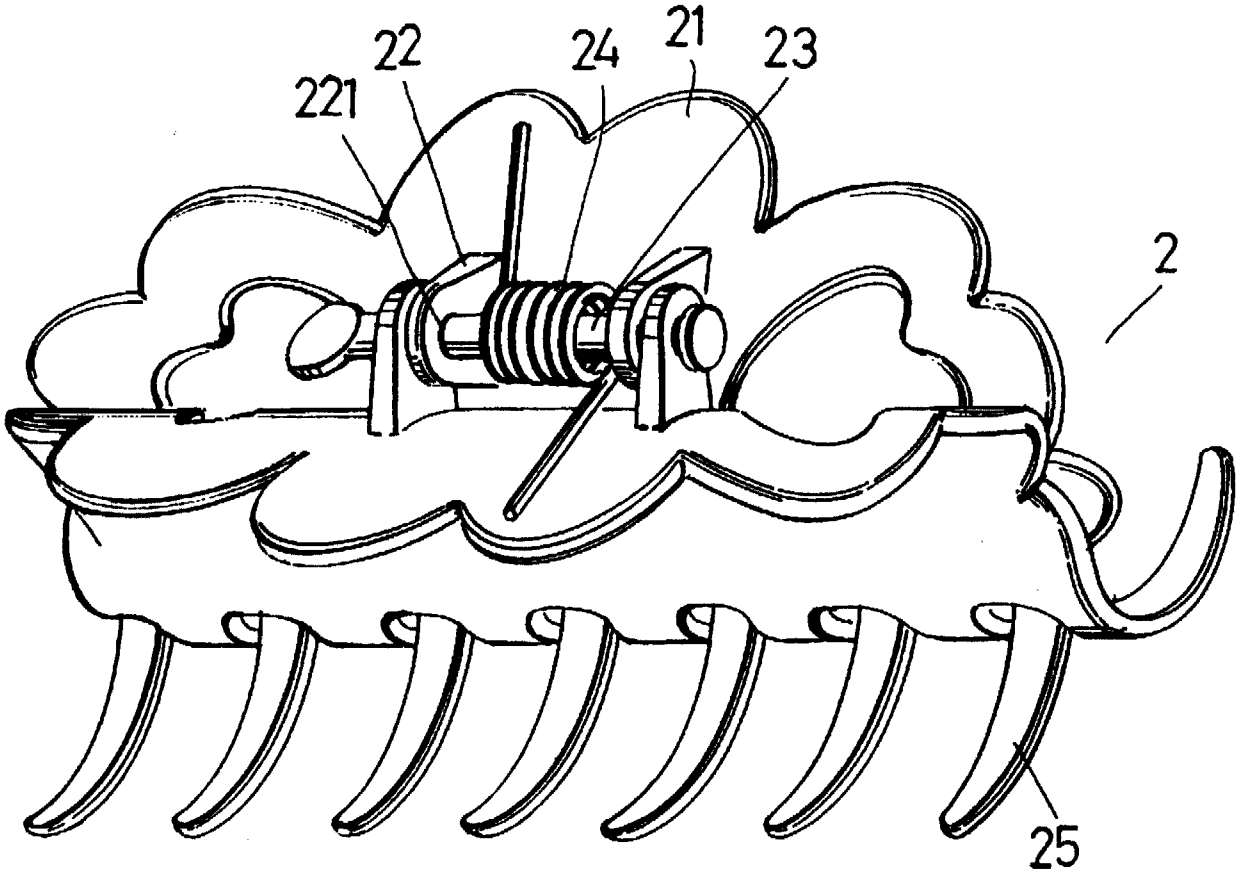
(PRIOR ART) Fig.8

Each of the clipping elements 1, 1' further has a snap holder 12, 12' (as shown in FIG. 2, 3) which are on the outer side thereof for the snap ends 131 to snap into so that the elastic rings 13 clip these two clipping elemements 1, 1' together.

As long as users press two finger presses 14, 14' inwardly with their fingers, the clipping teeth 15, 15' of the clipping elements 1, 1' seperate from each other for things or hair to be placed in between; then when the users release the finger presses 14, 14', the things or hair placed between the clipping teeth 15 and 15' will be clipped firmly and tightly due to the resilience of the elastic rings 13.

According to the above described, the hair clip of the present invention has advantages as follows:

1. the elastic ring 13 is made of stainless plastic steel which has great resilience and resistance to corrosion and so provides the hair clip with a good clipping effect and long service period;
2. the elements used in the hair clip described in the background of the invention, i.e., torsion spring and metal pin are replaced with elastic rings, thus the assembling process and the structure is simplified.

While the preferred embodiments of the invention have been described above, it will be recognized and understood that various modifications may be made therein and the appended claims are intended to cover all such modifications which may fall within the spirit and scope of the invention.

What is claimed is:

1. A hair clip comprising:

a first clipping element extending in a longitudinal direction having a first finger press area and plurality of clipping teeth, said first clipping element having a pair of longitudinally displaced first connecting protrusions extending from one side thereof, each of said first connecting protrusions having a respective longitudinally directed pin extending from respective outer surfaces thereof, said first clipping element having a pair of first snap holders formed on an outer side thereof forming a pair of first U-shaped insert recesses;

a second clipping element extending in said longitudinal direction having a second finger press area and plurality of clipping teeth, said second clipping element having a pair of longitudinally displaced second connecting protrusions extending from one side thereof, each of said second connecting protrusions having an aperture formed within a respective inner surface thereof, said first clipping element being hingedly coupled to said second clipping element by receipt of said pin of each of said pair of first connecting protrusions within said aperture of a respective one of said pair of second connecting protrusions, said second clipping element having a pair of second snap holders formed on an outer side thereof forming a pair of second U-shaped insert recesses, said first and second connecting protrusions being longitudinally displaced devoid of intervening elements; and, a pair of elastic ring members coupled to said first and second clipping elements for applying a bias force thereto, each of said pair of elastic ring members having opposing ends having a generally inverted U-shaped contour for insert and rocking engagement with a respective first and second clipping element within respective first and second insert recesses for engagement of a respective snap holder of each of said first and second clipping elements.

* * * * *